US009801507B2

(12) United States Patent
Reyes

(10) Patent No.: US 9,801,507 B2
(45) Date of Patent: Oct. 31, 2017

(54) CLEAN LIFT

(71) Applicant: Ruben Dario Reyes, Yonkers, NY (US)

(72) Inventor: Ruben Dario Reyes, Yonkers, NY (US)

( * ) Notice: Subject to any disclaimer, the term of this patent is extended or adjusted under 35 U.S.C. 154(b) by 67 days.

(21) Appl. No.: 14/879,459

(22) Filed: Oct. 9, 2015

(65) Prior Publication Data

US 2016/0135653 A1 May 19, 2016

(51) Int. Cl.
*A47K 13/10* (2006.01)

(52) U.S. Cl.
CPC ..... *A47K 13/105* (2013.01)

(58) Field of Classification Search
USPC ..... 4/246.1
See application file for complete search history.

(56) References Cited

U.S. PATENT DOCUMENTS 5,737,778 A * 4/1998 Black ..... A47K 13/105 4/246.1

* cited by examiner

*Primary Examiner* — Lauren Crane
(74) *Attorney, Agent, or Firm* — Myron Greenspan; Lackenbach Siegel LLP

(57) ABSTRACT

A unit created to maintain hygiene to lower and lift up the toilet seat without direct physical contact with the seat when being used. It will come in a plain cylindrical tubular vertical form and can be made from plastic, wood, or metal. It can remain right next to the toilet or on top of the tank cover standing on its base and does not need any batteries nor requires plugging for electricity use.

5 Claims, 9 Drawing Sheets

FIG. 1
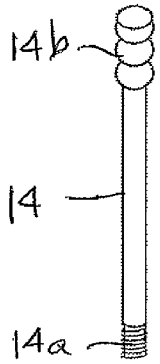
FIG. 2
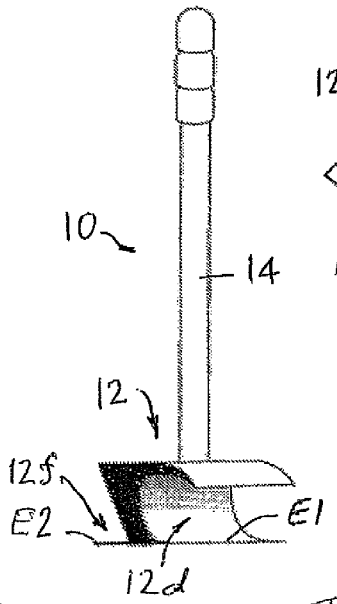
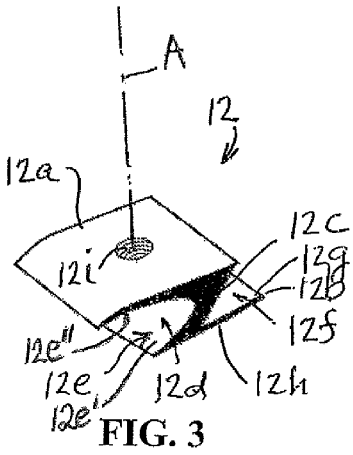
FIG. 3
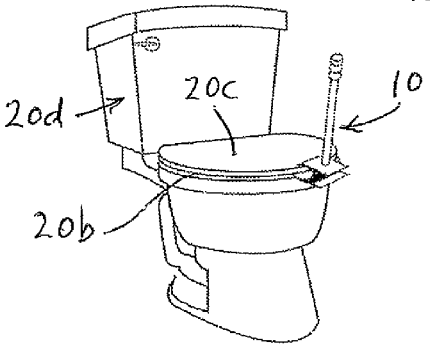
FIG. 4
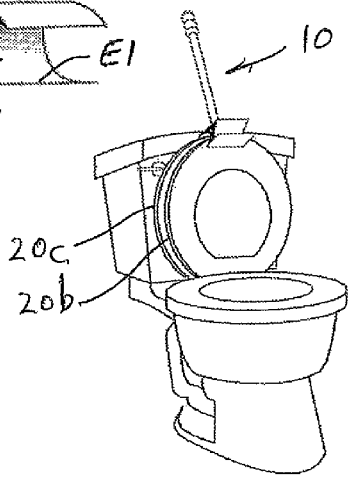
FIG. 5

CLEAN LIFT

BACKGROUND OF THE INVENTION

1. Field of the Invention

The invention generally relates to sanitary appliances and, more specifically, to a hygienic lifting device for lifting or lowering toilet seats, especially those in public restrooms.

2. Description of Related Art

It is generally common knowledge that bathrooms are, as a general rule, unsanitary and fertile breeding grounds for bacteria responsible for numerous diseases. This is especially true for surfaces of toilet seats in any bathroom but in particular in public bathrooms. What is needed is a way to lilt or lower a toilet seat without having to touch it or having to touch it.

SUMMARY OF THE INVENTION

The "Clean Lift" has a handle that would make it easier lift and lower the seat.

(a) This unit will have a cylindrical design with a main handle grip and a dual-hooked extension at the far end. The unit could measure approximately 24 inches long and could be produced from plastic. To use the "Clean Lift", the user would simply grip the handle and use the hooks to lift the seat.

(b) The unit could be offered in wide variety of colors and designs to match household decor. It would also be easy to store and clean and would durable and not rust. It would offer the consumer convenience, especially in a public restroom.

(c) The "Clean Lift" could be produced easily using conventional and readily available materials and manufacturing processes. No new production technology would be required. It could be produced from any number of hard, durable plastic formulations such as ABS, acrylic, polypropylene, phenolic resins or amino resins. These materials generally have good color ability, are reasonably priced, and are readily fabricated by a number of manufacturing processes, including injection molding.

(d) The "Clean Lift" could be packaged in a blister pack. This type of packaging consists of a piece of thin, clear polystyrene which has been molded to conform to the shape of the product being glued or otherwise attached to a piece of cardboard pressboard. The product would be placed in the molded polystyrene prior to its attachment to the cardboard. The cardboard pressboard could have the product name and other descriptive material, such as a sketch showing the product in use, printed on the front of the cardboard pressboard using a four-color printing process. Other material such as instructions for use could be printed on the back using black ink on stock. A single hole could be punched in the top of the cardboard pressboard for rack merchandising or for use with a point-of-purchase display. Corrugated cardboard shipping containers would then be used to hold a quantity of individually packaged products to facilitate shipment and storage.

BRIEF DESCRIPTION OF THE DRAWINGS

Those skilled in the art will appreciate the improvements and advantages that derive from the present invention upon reading the following detailed description, claims, and drawings, in which:

FIG. 1 shows the complete body of a unit in accordance with the invention;

FIG. 2 shows the top portion or handle of the unit shown in FIG. 1;

FIG. 3 shows the bottom portion of the unit that can be used to lift the toilet seat up or down;

FIG. 4 shows a demonstration on how the unit can be used to raise a toilet seat;

FIG. 5 shows a demonstration on how the unit can be used to lower a toilet seat;

FIG. 6 shows the base where the "Clean Lift" can rest on

DETAILED DESCRIPTION

Figure 6:
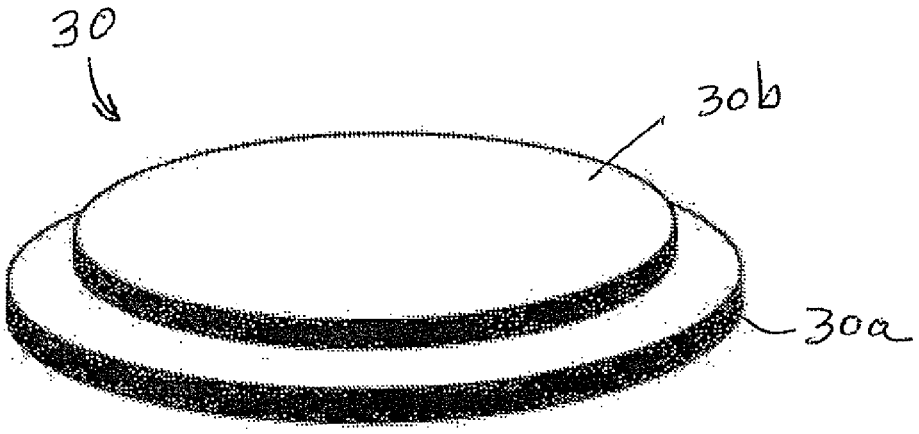

Referring now specifically to the Figures, in which identical or similar parts will be identified by the same reference numerals throughout, and first referring to FIG. 1, the device or unit in accordance with the present invention is generally designated by the reference numeral 10.

Also referring to FIGS. 2 and 3, the device 10 includes an engaging member 12 having a generally Z-shaped cross sectional configuration as shown in FIGS. 1 and 3. The member 12 includes a generally U-shaped curved wedge portion 12*a* and a straight wedge portion 12*b*, the portions 12*a*, 12*b* being joined by an inclined transition portion 12*c*. The curved wedge portion 12*a* forms a generally uniform U-shaped channel 12*d* that defines an arcuate surface 12*e* that includes both an upwardly facing surface portion 12*e*' and a downwardly facing surface portion 12*e*". The U-shaped channel is dimensioned to receive the edges of a toilet seat 20*b* and/or cover 20*c*. The straight portion 12*b* forms a generally triangular channel 12*f* that defines a flat surface 12*g* inwardly facing the wedge shaped channel 12*f* and a lower generally flat surface 12*h*. The curved wedge portion 12*a* is provided with a generally circular bore or opening 12*i* that is internally threaded and defines an axis A as shown in FIG. 3. The lifting device 10 includes a generally straight handle 14 having an external threaded end 14*a* dimensioned to be threadedly received within the threaded bore 12*i* and an enlarged handgrip 14*b*. The location and orientation of the axis A of the bore 12*i* in the member 12 are preferably selected so that when not in use the device can rest on the flat surface 12*h* with the handle 14 generally oriented in a vertical direction as shown.

Referring to FIG. 4, a typical or conventional toilet facility is shown referenced by the numeral 20. The facility 20 includes a bowl 20*a*, a seat 20*b* and a cover 20*c* generally pivotedly mounted on the bowl 20*a*. Frequently, a tank 20*d* is provided that typically has a generally horizontal surface at the top thereof.

Referring to FIG. 1 an edge E1 at the lower end of the arcuate surface 12*e* gradually increases in thickness due to the arcuate surface 12*e* while the thickness of the edge E2 is typically maintained along the entire straight portion 12*b*. Depending on the manufacture and style of the seat 20*b* and cover 20*c* it may be easier or advantageous to engage the seat 20*b*, cover 20*c* or both with either the edge E1 or E2. When one of the edges is inserted below the seat 20*b* or cover 20*c* a user can lift both of these pivoted components and engage the same and move them from one position to the other. Thus, for example, referring to FIG. 4, the device 10 is shown to be engaged while the cover and seat are in a lowered position. Upon engagement, the device can be raised thereby lifting the seat and/or cover. Similarly, in FIG. 5, with the seat and cover in the up position these can be engaged individually or together as suggested in the figure to lower them.

In FIG. 6, a base 30 is shown suitable for supporting the device 10 when not in use. Base 30 may include two separate, differently dimensioned portions 30*a*, 30*b* as shown.

Figure 7:
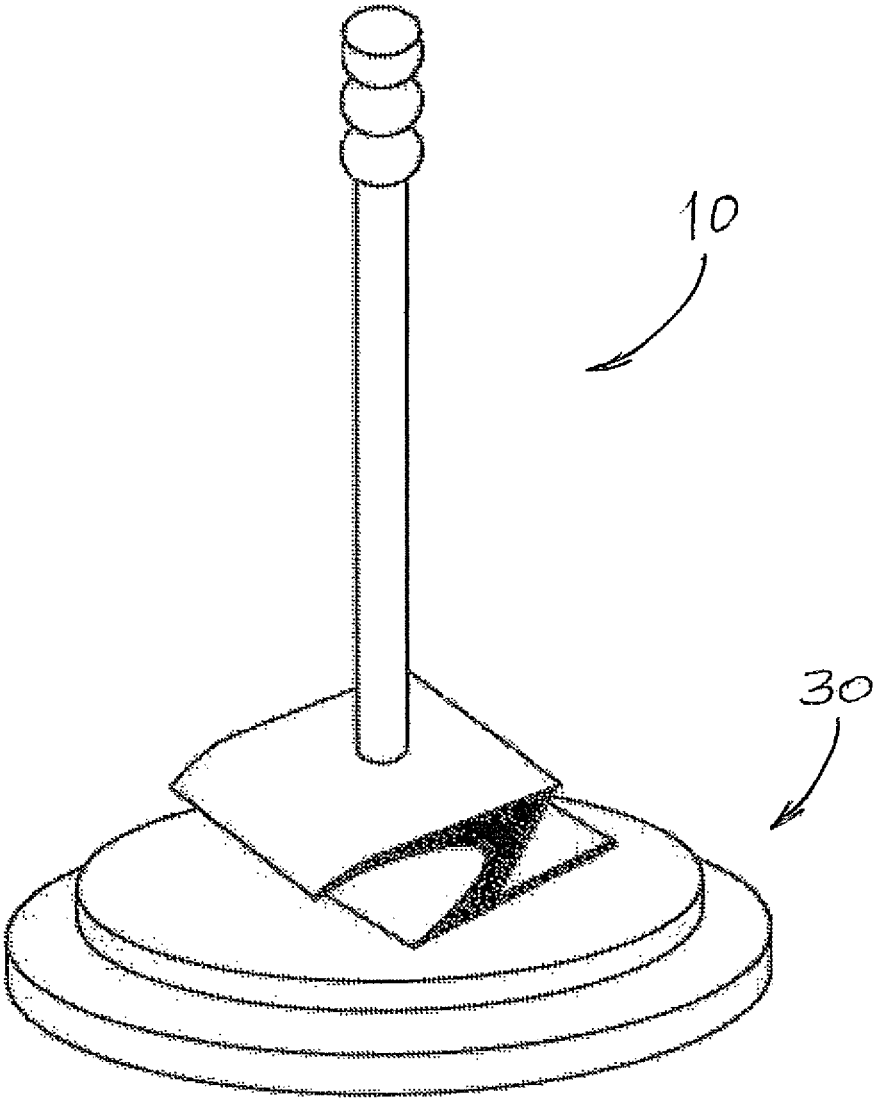
FIG. 7 shows how the "Clean Lift" rests on the base

Referring to FIG. 7, the device 10 is shown positioned on the base 30 as it may be when not in use.

Figure 8:
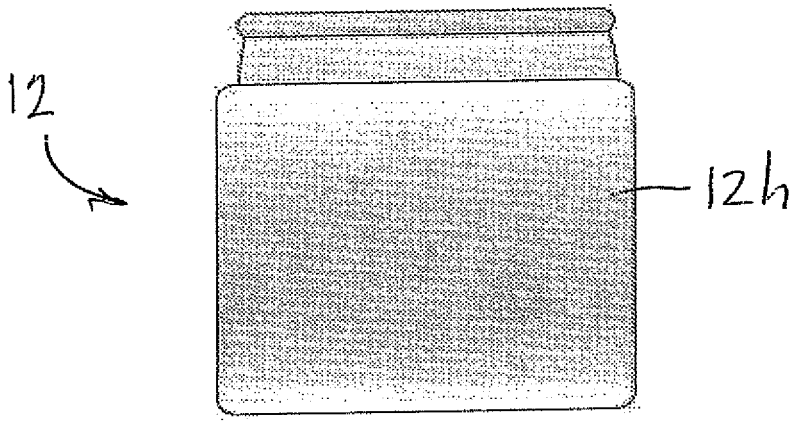
FIG. 8 shows how he bottom piece has a hook to be able to grasp the toilet seat and make it easier to pull down

FIG. 8 illustrates the bottom surface of the Z-shaped member 12, the dimensions of the base and in particular the portion 30*b* being dimensioned to support the surface 12*h*.

Figures 9, 9A:
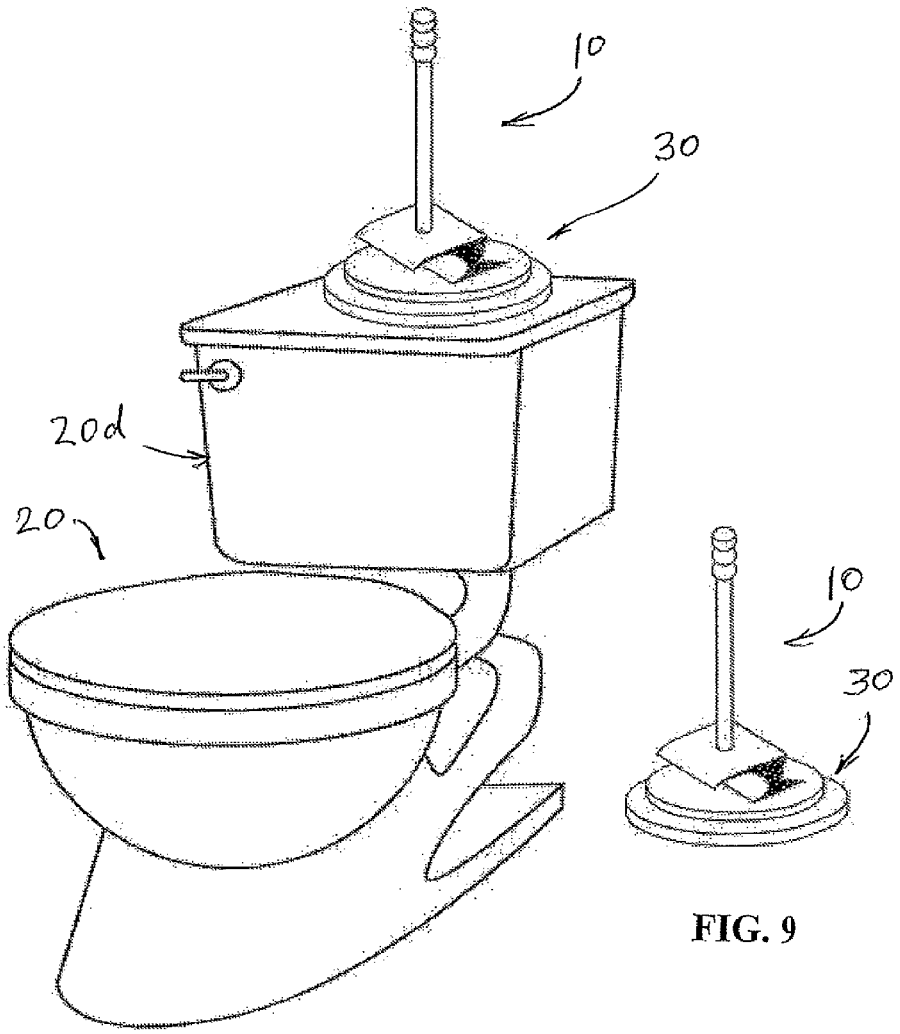
FIG. 9 shows how the "Clean Lift" can rest on its base either on the floor or on top of the toilet

In FIG. 9, the device is shown supported on the base 30 when same is placed on the floor, while FIG. 9*a* shows the base placed on top of the tank 20*d* for supporting the device 10.

Figure 10:
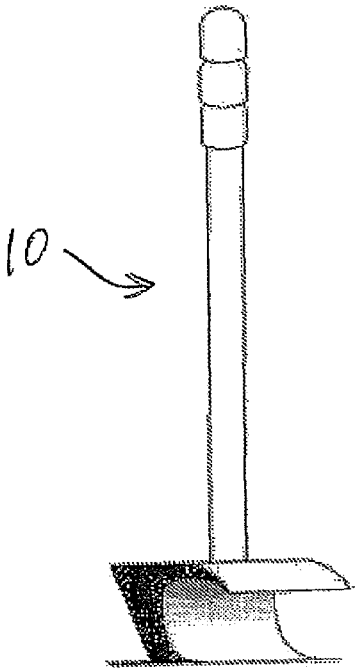
FIG. 10 shows the front side view of the "Clean Lift"
Figure 11:
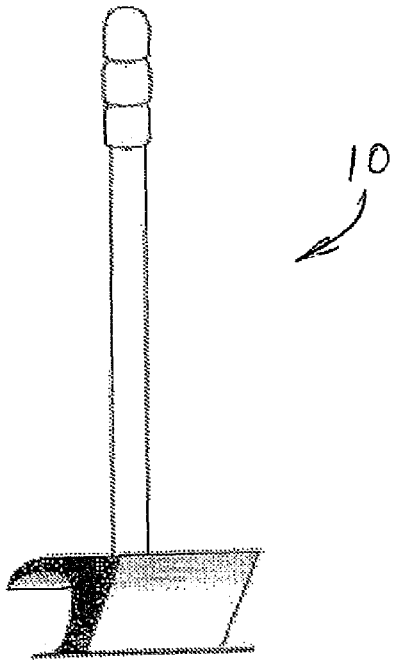
FIG. 11 shows the back side view of the "Clean Lift"

FIGS. 10 and 11 show more details of the device as seen from the front perspective in FIG. 10 and rear perspective in FIG. 11.

Figure 12:
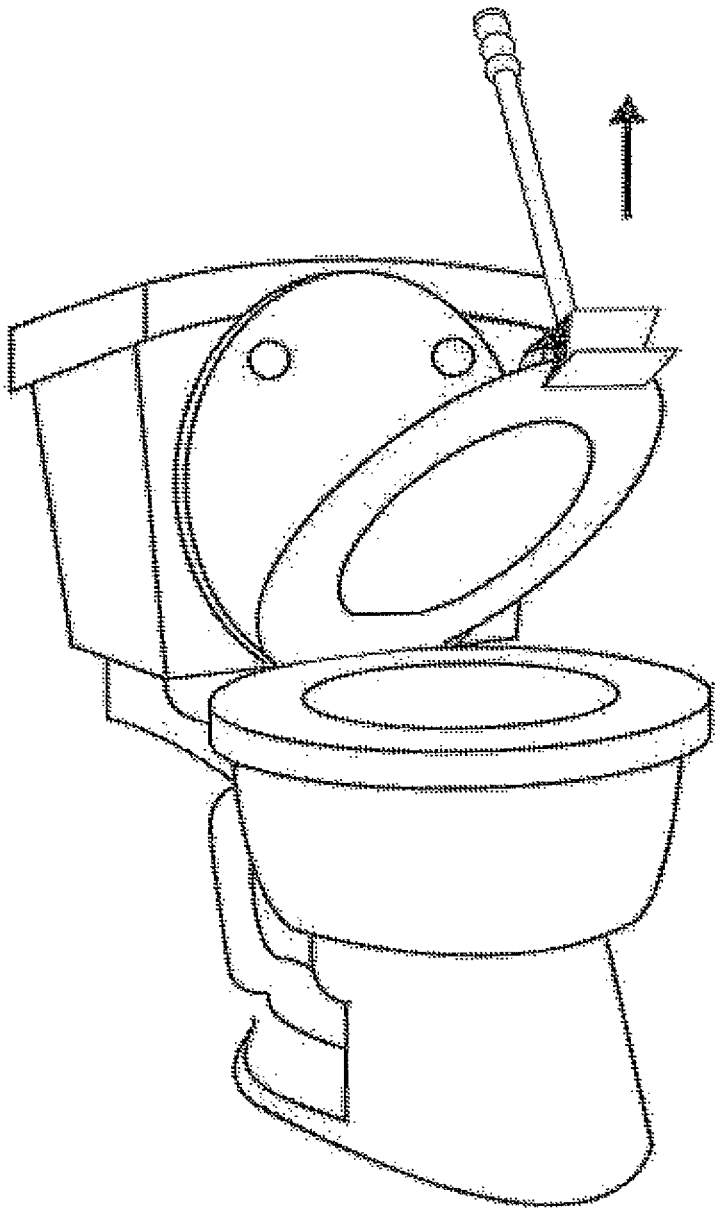
FIG. 12 shows a demonstration on how the "Clean Lift" will be used to bring the toilet seat up
Figure 13:
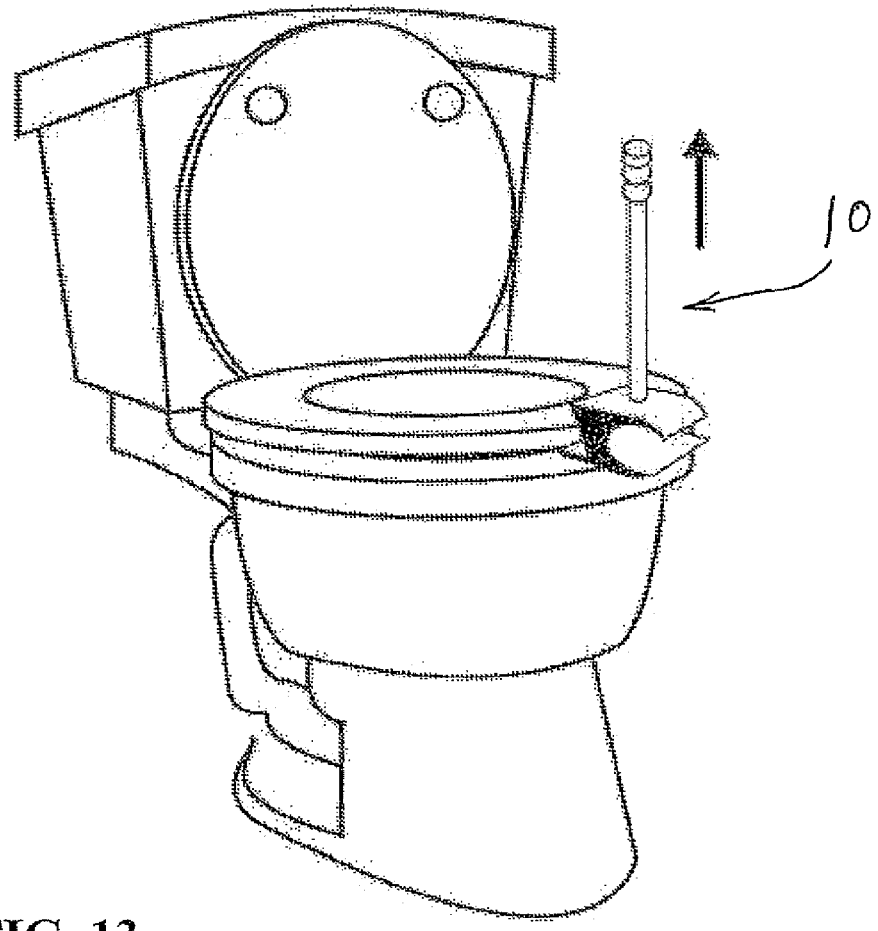
FIG. 13 shows a demonstration on how the "Clean Lift" can also be turned around and how you can use the other side to also lift the toilet seat
Figure 14:
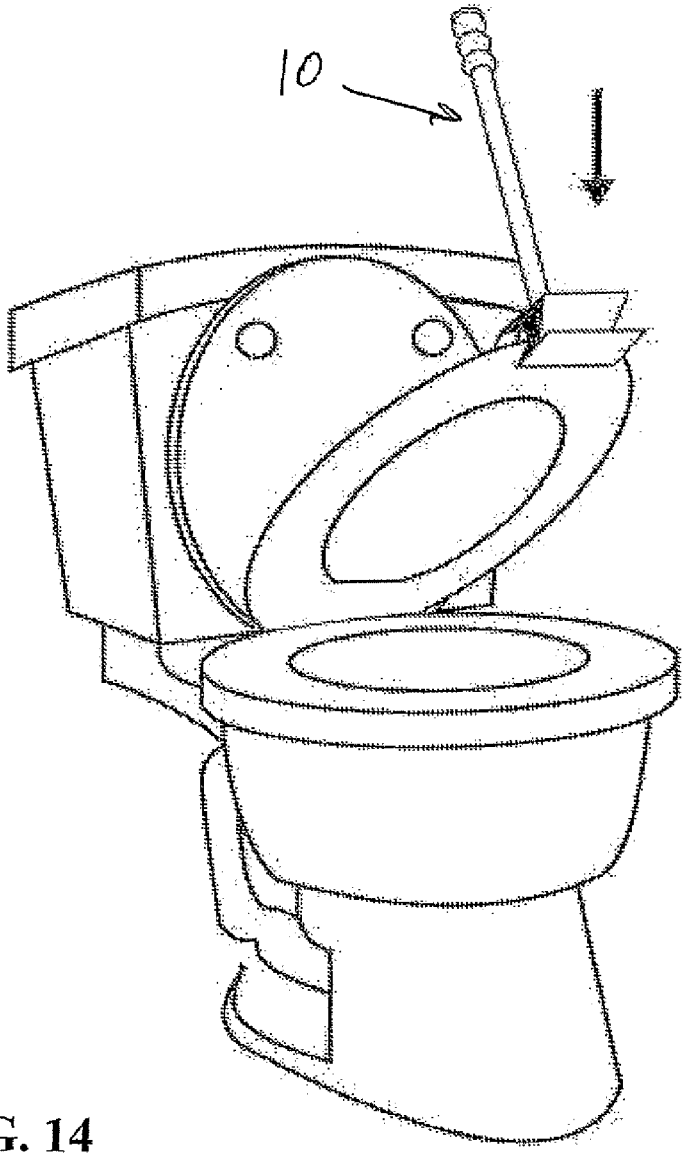
FIG. 14 shows how the "Clean Lift" is used to bring down the toilet seat and how the hook shown on FIG. 8 will make it easier to bring down

FIGS. 12-14 illustrate the manner in which the device 10 can be used to raise a seat, in FIG. 12, to raise a seat from a closed position in FIG. 13 and lowered from raised position in FIG. 14. Depending on the dimensions of the cover and/or seat one channel 12*d* or channel 12*f* can be used to facilitate manipulation of the components or parts to be moved as well as to prevent unnecessary damage to the surfaces of the components being moved. A feature of the invention is that both channels 12*d* and 12*f* can receive and engage a toilet seat and/or cover both from the bottom and top surfaces thereof so that these can be raised or lowered by raising the handle 14 (FIG. 13) or lowering the handle (FIG. 14) without separating the device 10 from the items to be moved.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sanitary handling device for toilet seats comprising an engaging portion;

an elongate handle attached to said engaging portion at one end and a handgrip at an opposing end, said engaging portion having a generally uniform Z-shaped configuration to form two wedging portions directed in opposite directions, each wedging portion forming substantially uniform channels forming generally upwardly and downwardly engaging surfaces and dimensioned to receive and engage a toilet seat and/or toilet seat cover, whereby each of said wedging portions can receive at least one of a toilet seat and cover to receive the same within one of said channels to raise or lower same by moving said handle upwardly or downwardly, respectively, while maintaining the same within a respective wedging portion.

2. A sanitary handling device as defined in claim 1, wherein one of said channels is curved.

3. A sanitary handling device as defined in claim 1, wherein one of said channels is triangular.

4. A sanitary handling device as defined in claim 1, wherein a wedging portion remote from said handle defines a flat surface suitable for positioning on a flat surface when the device is not in use.

5. A sanitary handling device as defined in claim 1, wherein an internally threaded bore on a wedge portion and an externally threaded end on said handle dimensioned to be received within said internally threaded bore.

* * * * *